US005961237A

United States Patent [19]

Kageyama et al.

[11] Patent Number: 5,961,237

[45] Date of Patent: Oct. 5, 1999

[54] WRITING INSTRUMENT

[75] Inventors: Shuhei Kageyama; Sachio Arai; Tadashi Yamamoto; Tadayoshi Ebinuma, all of Kawagoe, Japan

[73] Assignee: Kotobuki & Co., Ltd., Kyoto, Japan

[21] Appl. No.: 09/016,672

[22] Filed: Jan. 30, 1998

Related U.S. Application Data

[62] Division of application No. 08/925,877, Sep. 9, 1997, Pat. No. 5,810,496, which is a continuation of application No. 08/618,957, May 16, 1996, abandoned, which is a division of application No. 08/384,582, Jan. 17, 1995, Pat. No. 5,547,301, which is a continuation of application No. 08/143,085, Oct. 25, 1993, abandoned.

[30] Foreign Application Priority Data

| | | | |
|---|---|---|---|
| Dec. 3, 1992 | [JP] | Japan | 4-83448 |
| Feb. 12, 1993 | [JP] | Japan | 5-4262 |
| Mar. 15, 1993 | [JP] | Japan | 5-11124 |

[51] Int. Cl.[6] ..... B43K 24/06; B43K 7/12

[52] U.S. Cl. ..... 401/116; 401/99; 401/109

[58] Field of Search ..... 401/116, 99, 109

[56] References Cited

U.S. PATENT DOCUMENTS

| | | | |
|---|---|---|---|
| 3,436,160 | 4/1969 | Lanoie | 401/116 |
| 4,844,640 | 7/1989 | Ganz | 401/116 |

*Primary Examiner*—Steven A. Bratlie
*Attorney, Agent, or Firm*—David O'Reilly

[57] ABSTRACT

The present invention provides writing instruments having a mechanism for extending and retracting a writing tip and advancing a lead by rotational operation. The writing instrument is comprised of a front tubular member (1); a front inner tubular member (2) disposed within the front tubular member (1); a refill (3) inserted into the front inner tubular member (2); and a driver (10) mounted in the front tubular member (1) and the front inner tubular member (2). The driver (10) is allowed to rotate but not be axial displaced relative to the front tubular member (1) and the front inner tubular member (2). A rear tubular member (5) is detachably connected to the driver (10) so as not to allow rotation relative to the driver (10). A rear inner tubular member (4) is inserted in the driver (10). The rear inner tubular member (4) and the driver (10) interengage with each other by engagement between at least one axial groove (11) and corresponding projections (12). The writing instrument further comprises an inclined path (7) provided on one of either front inner tubular member (2) or the rear inner tubular member (4). The inclined path (7) extends obliquely relative to the axial line of the writing instrument from a beginning end (7A) and a terminal end (7B). A projection (8) provided on the other of either the front inner tubular member (2) or the rear inner tubular member (4), engages the inclined path (7).

2 Claims, 9 Drawing Sheets

WRITING INSTRUMENT

CROSS-REFERENCE TO RELATED APPLICATIONS

This application is a division of applicants' patent application Ser. No. 08/925,877 filed Sep. 9, 1997 now U.S. Pat. No. 5,810,496; which is a continuation of application Ser. No. 08/618,957 filed May 16, 1996 abandoned; which is a divisional of application Ser. No. 08/384,582 filed Jan. 17, 1995 now U.S. Pat. No. 5,547,301 issued Aug. 20, 1996; which is a continuation of application Ser. No. 08/143,085 filed Oct. 25, 1993 abandoned.

BACKGROUND OF THE INVENTION

1. Field of the Invention

The present invention relates to a writing instrument having a mechanism for transforming rotation of the rear tubular member into axial displacement of a writing tip.

2. Background Information

In the prior art, the writing tip of a writing instrument, for example a ball-point pen can be extended or retracted in response to directions of rotation of a rear tubular member of the writing instrument. The writing instrument can be used when the writing tip extends outwards from a front tubular member of the writing instrument.

In mechanical pencils of prior art, after the writing tip is extended outward from a front tubular member of the pencil in response to rotation of a rear tubular member of the mechanical pencil, a lead advancing mechanism is activated by a knock operation so that a lead projects from the writing tip, and then the pencil can be used.

In ball-point pens of the prior art, there is the problem of the mechanism for transformation of rotation and axial displacement presenting a mechanically complicated structure. Also in mechanical pencils of the prior art, there is the problem that they not only need the mechanism for transformation of rotation and axial displacement but also need a lead advancing mechanism to be activated by a knock operation, thereby the construction becomes further complicated. Further they need both a rotation operation and knocking operation, thus they lack simplicity and costs are increased.

Accordingly, it is an object of the invention to provide a writing instrument which can solve the above problems and whose construction is simpler and convenient.

It is a further object of the invention to provide a mechanical pencil which can solve the above problems and whose operation is easy.

In order to solve the above problems, a writing instrument according to the present invention comprises a front tubular member; a front inner tubular member disposed within the front tubular member; a refill inserted into the front inner tubular member; and a driver mounted in the front tubular member and front inner tubular member. The driver is allowed to rotate but not displace axially relative to the front tubular member and front Inner tubular member. A rear tubular member is detachably connected to the driver but not allowed to rotate relative to the driver; and a rear inner tubular member is inserted in the driver. An inclined path is provided on either the front inner tubular member or the rear inner tubular member. The inclined path extends obliquely relative to an axial line of the writing instrument from a beginning end to a Terminal end; and a projection is provided on the other of either the front inner tubular member or the rear inner tubular member. The projection engages the inclined path. The rear inner tubular member and the driver interengage with each other by engagement between at least one axial groove and a corresponding projection so as to allow axial displacement but no rotation relative to the driver.

The inclined path can be narrower at the beginning end and the terminal end than the other portion thereof so that a user can clearly realize the beginning end or the terminal end is reached.

The inclined path can have a first inclined path and second inclined path extending on an opposite side of the first inclined path so that a beginning end of the first inclined path coincides with a beginning end of the second inclined path.

Alternatively, the inclined path can have a first inclined path and second inclined path following the first inclined path so that a terminal end of the first inclined path coincides with a beginning end of the second inclined path.

The beginning end of the inclined path may be in communication with a rear inner void space of the writing instrument.

The beginning end of the inclined path may also be in communication with a rear inner void space of the writing instrument through a closed slit.

The beginning end of the inclined path may be in communication with a rear inner void space of the writing instrument through a closed slit and an open slit.

Alternatively, an engaging member having the inclined path is provided, and a slot is formed in one of either the front inner tubular member or the rear inner tubular member and having substantially the same shape as the engaged plate. The engaging member is engaged with the slot.

The writing instrument may further comprise friction generating means provided between the front inner tubular member and the driver for generating friction between them.

Alternatively, the writing instrument may further comprise friction generating means provided between the front inner tubular member and the rear inner tubular member for generating friction between them.

Alternatively, the projection can bend in a radial direction so that it can engage the inclined path by its flexibility. At least one slit provided in the vicinity of the projection allows the projection to bend in a radial direction. Otherwise either the front inner tubular member or the rear inner tubular member on which the projection is provided may have a cut off on the opposite side of the projection so that the projection can pass through either the front inner tubular member or the rear inner tubular member to engage with the inclined path.

Further a mechanical pencil according to the present invention comprises; a front tubular member; a front inner tubular member disposed within the front tubular member; a lead advancing assembly inserted into the front inner tubular member; and a driver mounted in the front tubular member and front inner tubular member which allows rotation but not axial displacement, relative to the front tubular member and the front inner tubular member. A rear tubular member is detachably connected to the driver which is not allowed to rotate relative to the driver; and a rear inner tubular member is inserted in the driver to allow axial displacement but not rotation relative to the driver. An inclined path is provided on either the front inner tabular member or the rear inner tubular member. The inclined path extends obliquely relative to an axial line of the mechanical pencil from a beginning end to a terminal end; and a projection is provided on either of the front inner tubular member or the rear inner tubular member, which engages with the inclined path. Therefore the lead advancing assembly can advance toward the front inner tubular member and the front tubular member as the rear inner tubular member advances.

The lead advancing assembly includes a lead casing extending toward a rear inner portion of the mechanical pencil.

Alternatively, the lead advancing assembly includes a joint member extending toward a rear inner portion of the mechanical pencil and a rear peripheral wall of said joint member defines a lead storage compartment together with a peripheral wall of the rear inner tubular member.

Operation of the writing instruments according to the present invention is carried out as follows.

In Case of a Ball-Point Pen

If the rear tubular member is rotated, the rear inner tubular member and refill rotate together with the rear tubular member, making the projection advance from the beginning end of the inclined path along the inclined path, to make a writing tip of a refill advance. When the projection reaches the terminal end of the inclined path, the writing tip projects from an extreme point of the front tubular member. In this position, the pen can be used to write.

If the rear tubular member is rotated in a direction opposite to the above, the rear inner tubular member and refill rotation is reversed, making the projection of the rear inner tubular member retract from the terminal end along the inclined path making the writing tip of the refill retract into the extreme point of the front tubular member when the projection returns to the beginning end of the inclined path.

In Case of a Mechanical Pencil

If the rear tubular member is rotated, the rear inner tubular member and refill advance, making the writing tip (i.e. front pipe of a slider or tip of a lead) of a refill advance, making the writing tip project from an extreme point of the front tubular member when the projection reaches the terminal end of the inclined path.

If the inclined path has a first inclined path and second inclined path extending on an opposite side of the first inclined path so that the beginning end of said first inclined path coincides with the beginning end of said second inclined path, the projection moves from the beginning end to the terminal end along the first inclined path, making the writing tip (front pipe of a slider or tip of a lead) project to serve as a pencil. When the projection reaches the terminal end of the second inclined path, a chuck of a mechanical pencil can be maintained open to free a lead thereby the writing tip can be pushed into the front tubular member.

If the inclined path has first inclined path and second inclined path following the first inclined path so that the terminal end of the first inclined path coincides with the beginning end of the second inclined path, the writing tip is pushed out from an extreme point of the front tubular member when the projection reaches the terminal end from the beginning end along the first inclined path. Further, the projection can reciprocally move between the beginning end and the terminal end of the second inclined path, advancing a lead from the writing tip to serve as a pencil.

Other objects and advantages of the invention will become apparent from the following portion of this specification and from the accompanying drawings.

DESCRIPTION OF THE PREFERRED EMBODIMENTS

Figure 1:
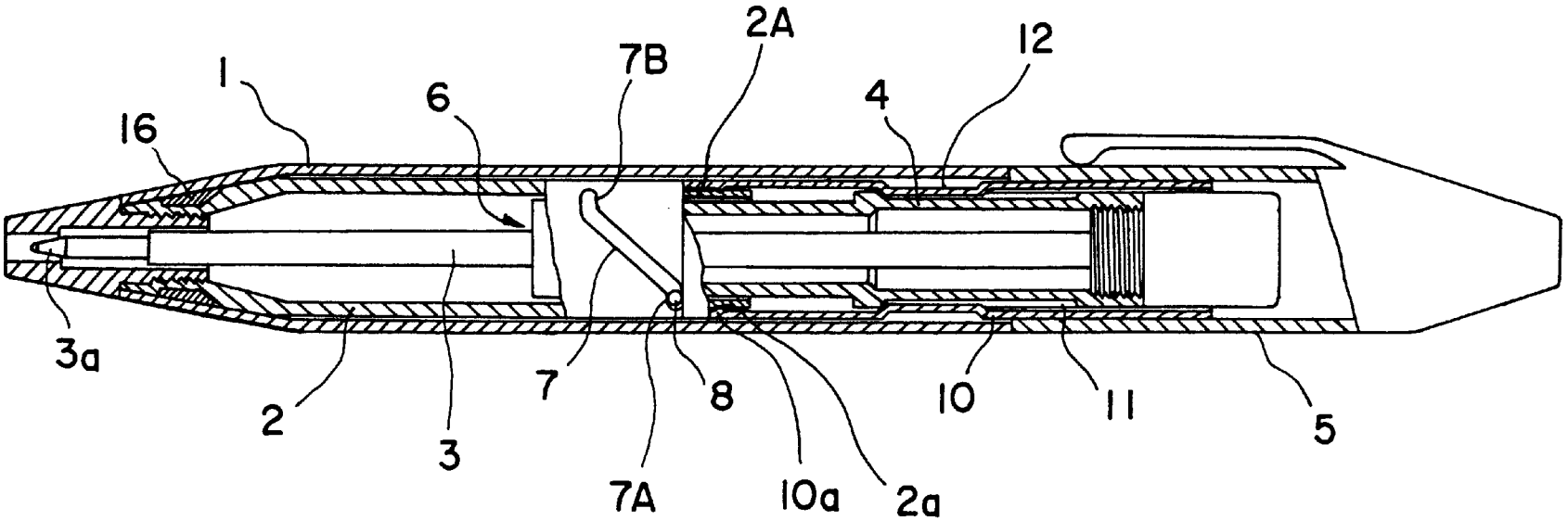
FIG. 1 is a longitudinal sectional view showing an embodiment of the writing instrument according to the present invention.

FIG. 1 is a longitudinal sectional view showing an embodiment of the writing instrument according to the present invention, as applied to a ball-point pen.

Firstly, its construction will be explained. In FIG. 1, a ball-point pen has front tubular member 1 , front inner tubular member 2 mounted within front tubular member 1 including rear end portion 2A having a smaller diameter and annular engaging portion 2*a* formed on an outer surface of rear end portion 2A. Rubber-bushing 16 is arranged between the front end of front tubular member 1 and the front end of front inner tubular member 2. Refill 3 for ball-point pen ink is disposed within front inner tubular member 2, and driver 10 is included.

Driver 10 includes projection 10*a* to engage annular engaging portion 2*a* on an inner surface of a front portion of driver 10 and a plurality of projecting portions 12 extending inwards on an inner surface of an intermediate portion. Projection 10*a* engages annular engaging portion 2*a*, thereby the front portion of driver 10 is disposed between front tubular member 1 and rear end portion 2A, permitting angular displacement relative to front tubular member 1 and front inner tubular member 2 but preventing axial displacement relative to them. Also driver 10 is detachably connected to rear tubular member 5, but not allowed to rotate relative to rear tubular member 5. Alternatively, the annular engaging portion and projection may be provided vice versa, or may be provided on driver 10 and front tubular member 1.

Rear inner tubular member 4 is inserted into front inner tubular member 2. Refill 3 is fixed to rear inner tubular member 4. Inclined slot 7 formed on front inner tubular member 2 has beginning end 7A and terminal end 7B apart circumferentially from each other. On the other hand, projection 8 to slidably engage inclined slot 7 is provided on rear inner tubular member 4. Alternatively, the projection and inclined slot may be provided vice versa. Preferably, inclined slot 7 has a smaller diameter at beginning end 7A and terminal end 7B than the other portion thereof so that a user can feel and realize that projection 8 is inserted in ends 7A, 7B or projection 8 has escaped from ends 7A, 7B.

Figure 2A:
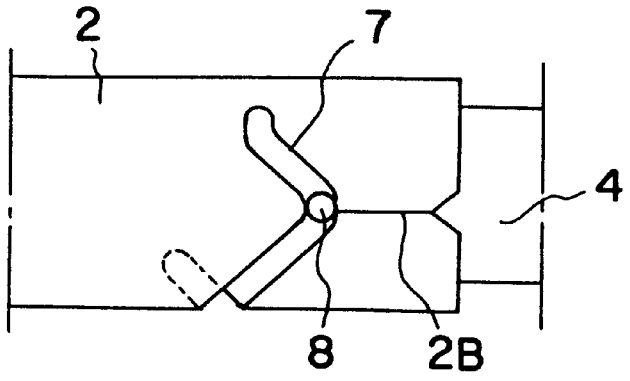
FIG. 2(A) is an explanatory view showing a partial construction of the embodiment of FIG. 1.
Figure 2B:
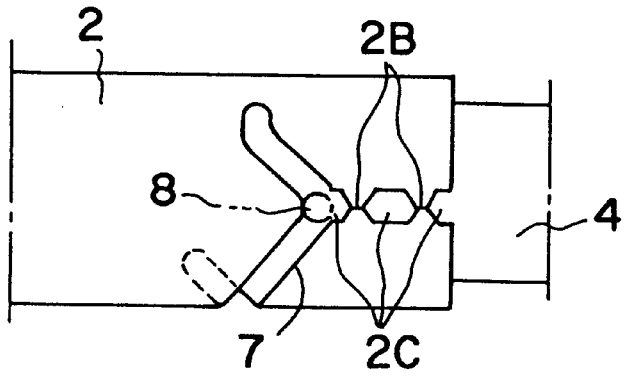
FIG. 2(B) is an explanatory view showing another partial construction and FIG. 2(C) is an explanatory view showing still another partial construction.

As shown in FIG. 2(A), beginning end 7A is in communication with a rear inner void space of driver 10 through close slit 2B so that projection 8 can be inserted from its open end into slot 7 through close slit 2B when assembling the parts. Accordingly, it is easy to set projection 8 at the beginning end 7A and it is difficult for projection 8 to fall out from beginning end 7A once projection 8 is set. An alternative example is shown in FIG. 2(B) wherein beginning end 7A is in communication with a rear inner void space of driver 10 through close slit 2B and open slit 2C. This example operates the same as the one of FIG. 2(A).

Figure 2C:
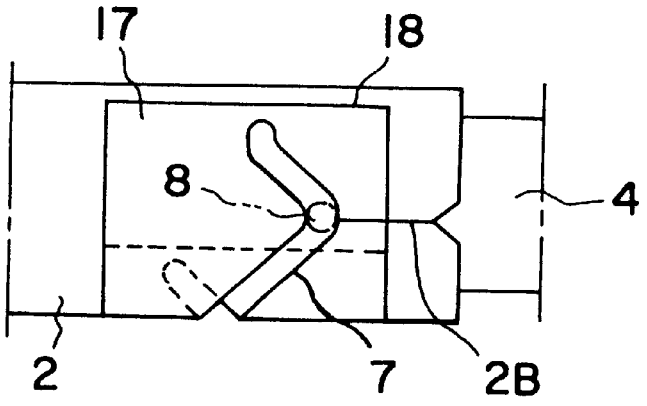

FIG. 2(C) shows another construction of front inner tubular member 2 and rear inner tubular member 4. First inner tubular member 2 has hole 18 formed in a rear portion thereof. Hole 18 communicates with close slit 2B. Engaging member 17 having substantially the same shape as hole 18 has inclined slot 7 formed therein. Upon assembling front inner tubular member 2, after engaging member 17 engages hole 18, front inner tubular member 2 is inserted into front tubular member 1. Since engaging member 17 is surrounded by front tubular member 1 or driver 10 after assembling, engaging member 17 is prevented from disengaging from hole 18. In the construction, it is easy to produce front inner tubular member 2 because inclined slot 7 need not be directly formed in front inner tubular member 2.

FIGS. 7–12 show alternative constructions of rear inner tubular member 4.

Figure 7:
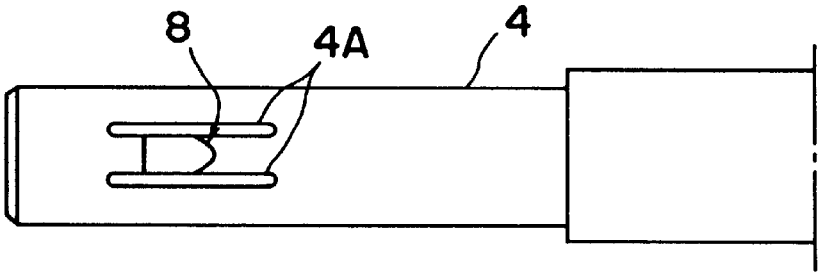
FIG. 7 is a plan view of a front portion of the rear inner tubular member.
Figure 8A:
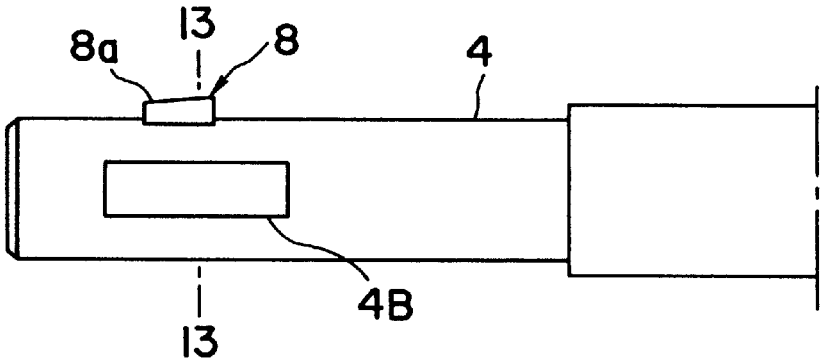
FIG. 8(A) is a plan view showing another example of a front portion of the rear inner tubular member and FIG. 8(B) is a sectional view at 8—8 line of FIG. 8(A)
Figure 8B:
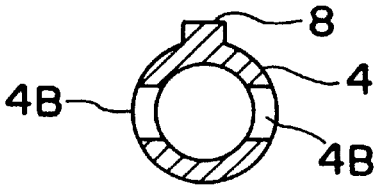
Figure 9:
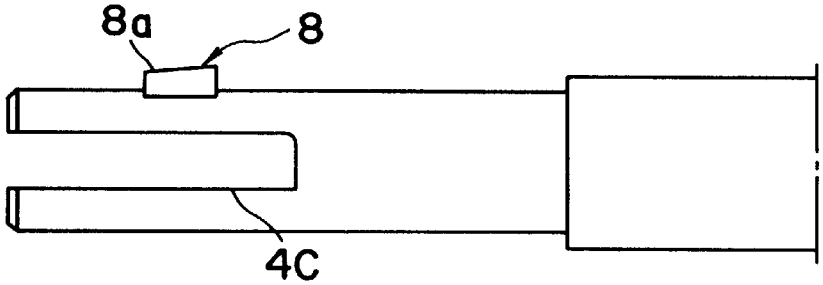
FIG. 9 is a plan view of yet another example of a front portion of the rear inner tubular member.

In FIGS. 7–9, rear inner tubular member 4 has slots 4A or slot 4B or 4C in the vicinity of projection 8. Slots 4A or slot 4B, 4C enable projection 8 to bend inward because of its flexibility and pass through front inner tubular member 2 to engage inclined path 7 without slits like 2B or 2C. Preferably, projection 8 has a tapered top face 8*a* in order to easily pass through front inner tubular member 2.

Figure 10:
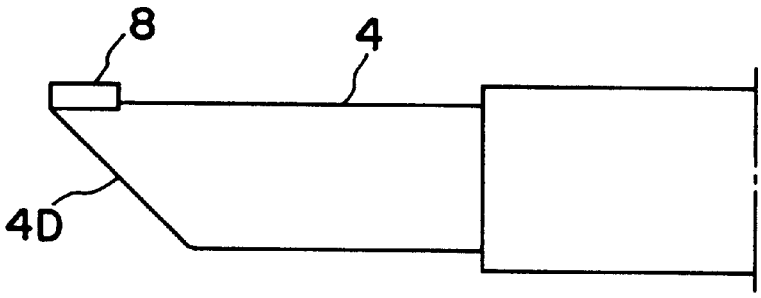
FIG. 10 is a plan view of still another example of a front portion of the rear inner tubular member.
Figure 11:
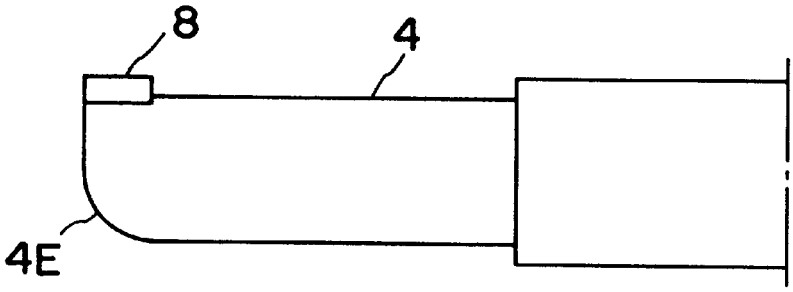
FIG. 11 is a plan view of a further another example of a front portion of the rear inner tubular member.
Figure 12A:
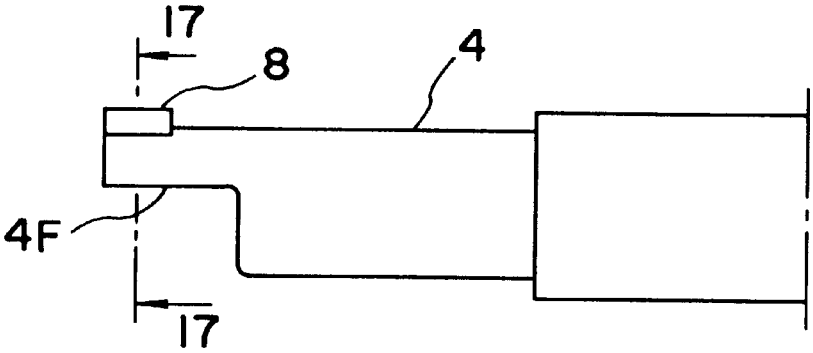
FIG. 12(A) is a plan view of a still further another example of a front portion of the rear inner tubular member and FIG. 12(B) is a section view at 12—12 of FIG. 12(A).
Figure 12B:
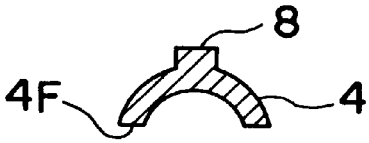
Figure 12:
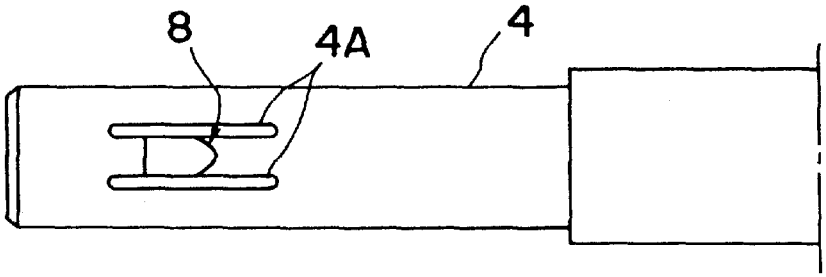
Figure 13A:
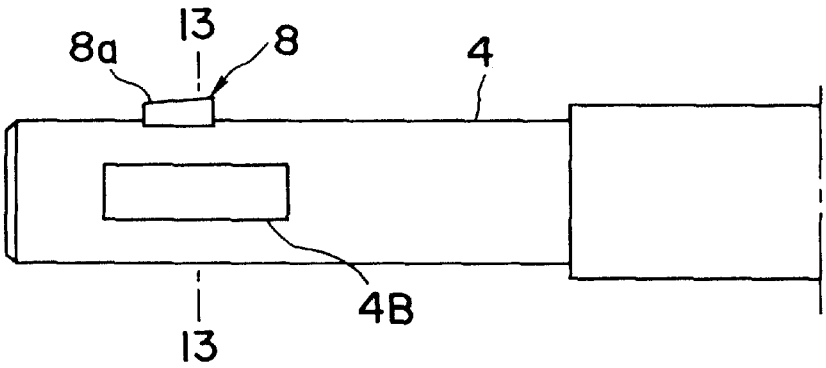
Figure 13B:
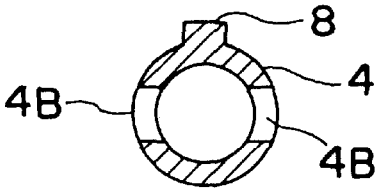
Figure 14:
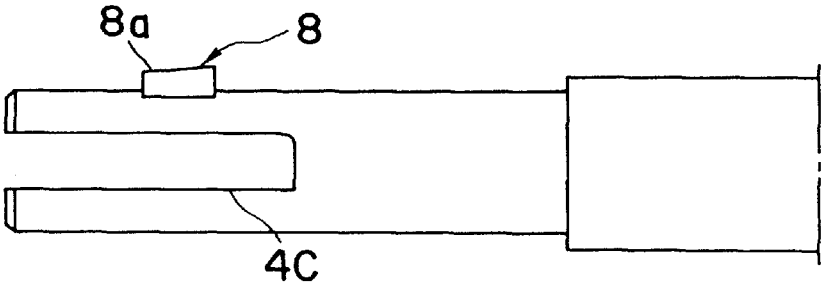
Figure 15:
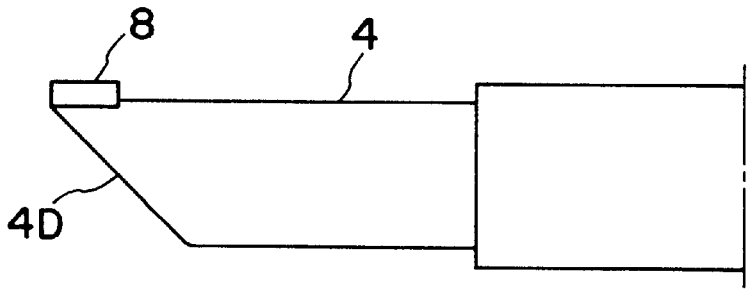
Figure 16:
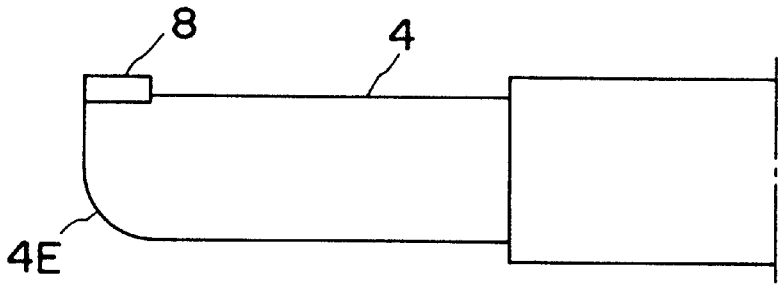
Figure 17A:
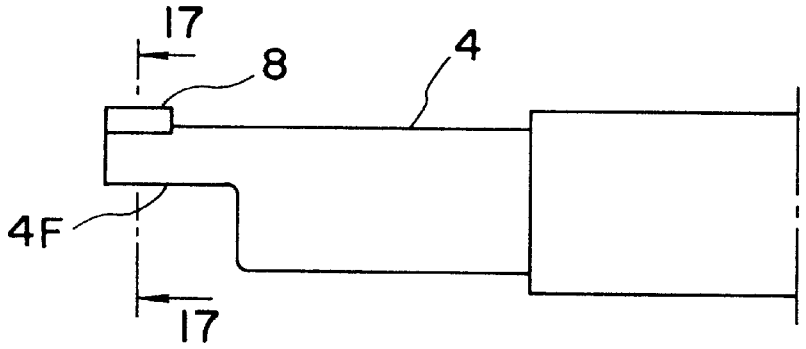
Figure 17B:
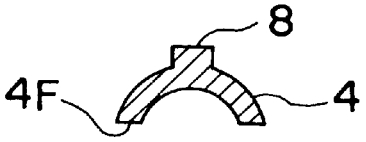

In FIGS. 10 through 12, rear inner tubular member 4 has cut off 4D, 4E, 4F on the opposite side of projection 8. Cut off 4D in FIG. 10 is a slope, cut off 4E in FIG. 11 is arch-shaped, and cut off 4F in FIG. 12 is step-shaped. In each cases, projection 8 can pass through front inner tubular member 2 to engage inclined path 7 without slits like 2B or 2C.

Returning to FIG. 1, a plurality of axial grooves 11 are formed on an outer surface of rear inner tubular member 4, and the plurality of projecting portions 12 to engage corresponding axial grooves are provided on the inner surface of driver 10. If the number of axial grooves 11 is much greater than projecting portions 12, engagement of both parts is easier and preferable. Alternatively, axial grooves and projections may be provided vice versa, or the number of axial grooves may be much less than the projections. In the alternative structure, the engagement operation can also be done quickly.

The operation of this embodiment will be explained hereinafter. If rear tubular member 5 is rotated, rear inner tubular member 4 and refill 3 for ball-point pen ink rotate together with rear tubular member 5, making projection 8 of rear inner tubular member 4 advance from beginning end 7A of front inner tubular member 2 along inclined slot 7, making writing tip 3*a* of refill 3 advance. When projection 8 reaches terminal end 7B of inclined slot 7, writing tip 3*a* can project from an extreme point of front tubular member 1. In this arrangement, the pen can be used to write.

If rear tubular member 5 is rotated in a direction opposite to the above, rear tubular member 4 and refill 3 reverse rotation, making projection 8 of rear inner tubular member 4 retract from terminal end 7B of front inner tubular member 2 along inclined path 7, making writing tip 3*a* of refill 3 retract into the extreme point of front tubular member 1 when projection 8 returns to beginning end 7A of inclined path 7.

Figure 3:
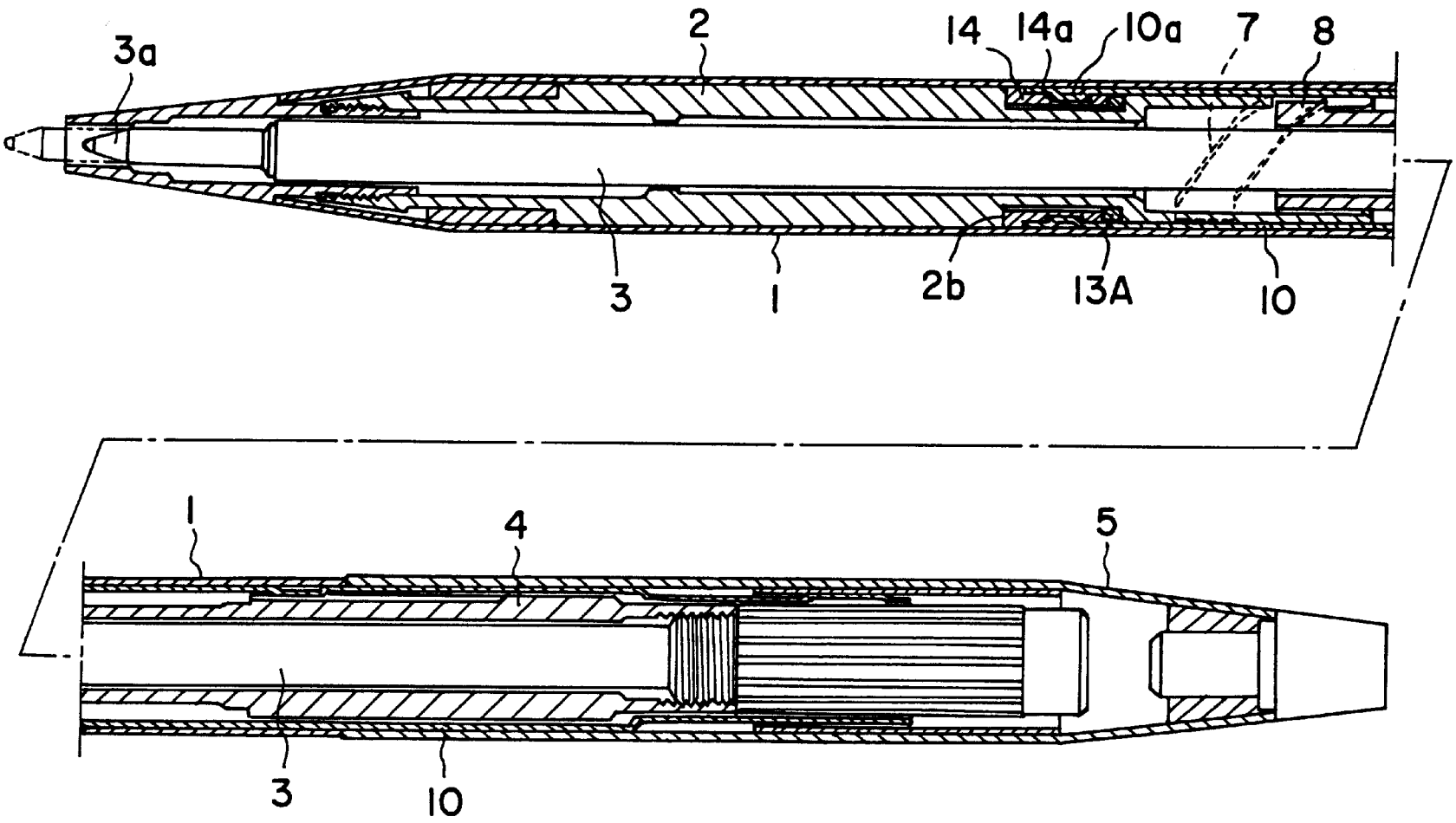
FIG. 3 is a longitudinal sectional view showing another embodiment of the writing instrument according to the present invention.

FIG. 3 is a longitudinal sectional view showing another embodiment of the writing instrument according to the present invention, as applied to a ball-point pen. In this embodiment, annular engaging member 14 is used instead of annular engaged portion 2*a* and projection 10*a* of the aforesaid embodiment.

Annular groove 2*b* is formed on an outer surface of front inner tubular member 2 and annular engaging member 14 is disposed within annular groove 2*b* allowing rotation relative to front inner tubular member 2. On the other hand, annular projection 10*a* provided on an inner surface of a front end of driver 10, engages annular groove 14*a* formed on an outer surface of annular engaging member 14. Accordingly, driver 10 can move with annular engaging member 14, and can be mounted on front inner tubular member 2 to allow rotation relative to it but not allow axial displacement relative to it.

Since driver 10 is typically made of metal while front tubular member 2 is made of plastic, it is sometimes difficult for both members to be rotatable and in direct contact. In the embodiment, using annular engaging member 14 made of plastic ensures driver 10 is rotatable but not axially removably mounted on front tubular member 2.

Also in the embodiment of FIG. 3, O-ring 13A serves as a friction generating member provided in annular groove 2*b* adjacent to annular engaging member 14. O-ring 13A is compressed between driver 10 and front inner tubular member 2 so that O-ring 13A generates a friction force between them. As a result, when rotating rear tubular member 5 and moving projection 8 along inclined path 7, O-ring 13A gives a user the sense of massiveness or stability, further imparting a sense of high-class. O-ring 13A may be disposed at other positions, such as, on surfaces of either driver 10 or front inner tubular member 2 which slidably contacts a surface of the other, or surfaces of either front inner tubular member 2 or rear inner tubular member 4 which slidably contacts a surface of the other.

Figure 4:
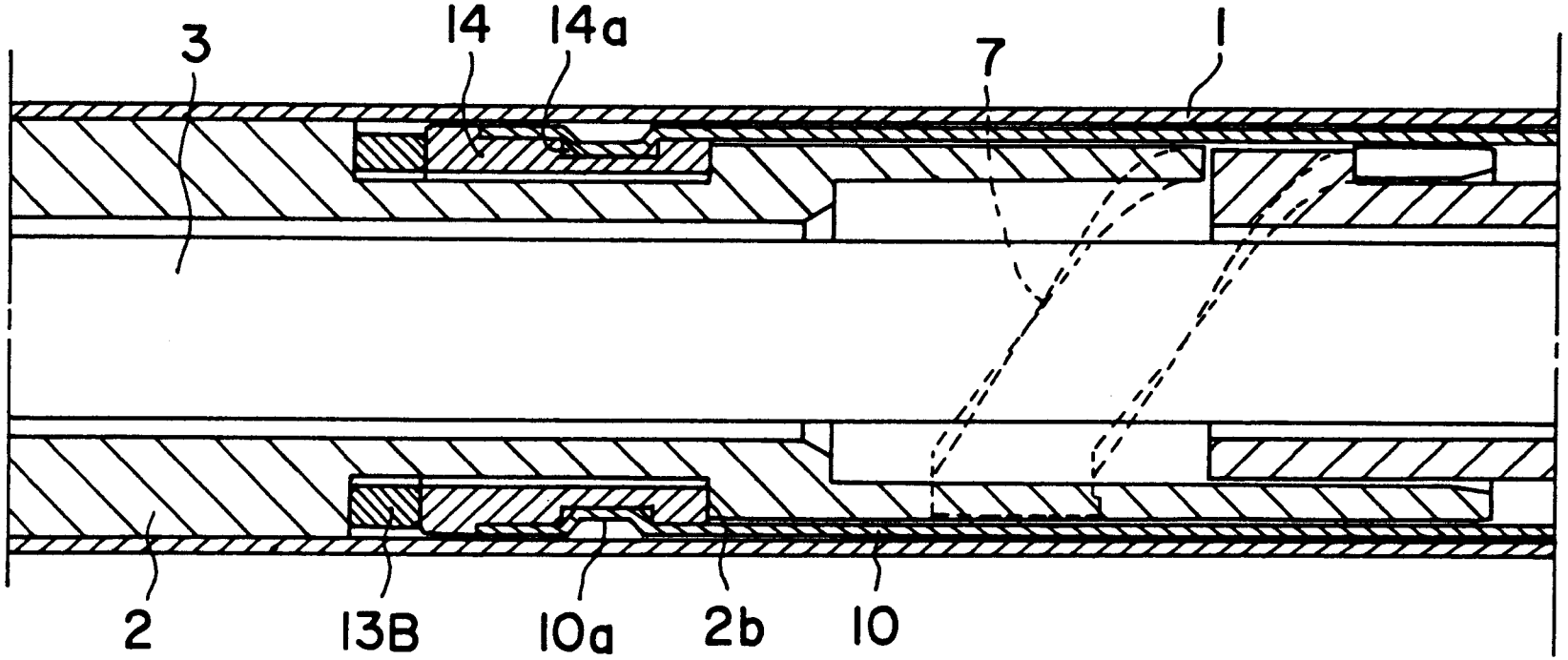
FIG. 4 is a sectional view of a friction generating means.
Figure 5A:
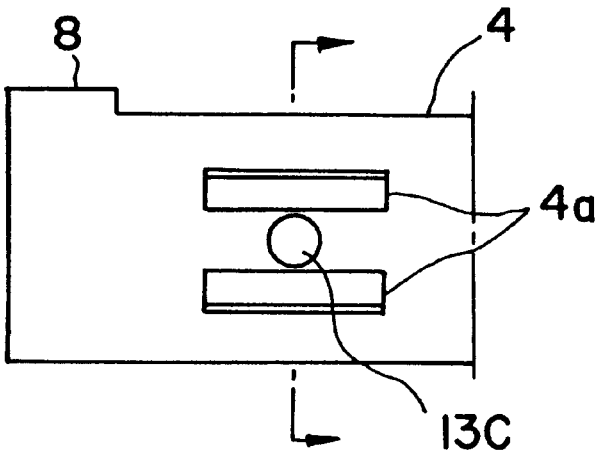
FIG. 5(A) is a partial front view of the rear inner tubular member showing another example of a friction generating means and FIG. 5(B) is a sectional view of FIG. 5(A)
Figure 5B:
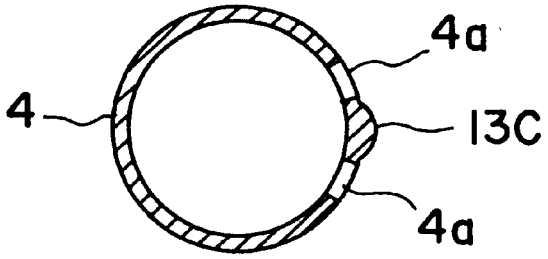
Figure 6:
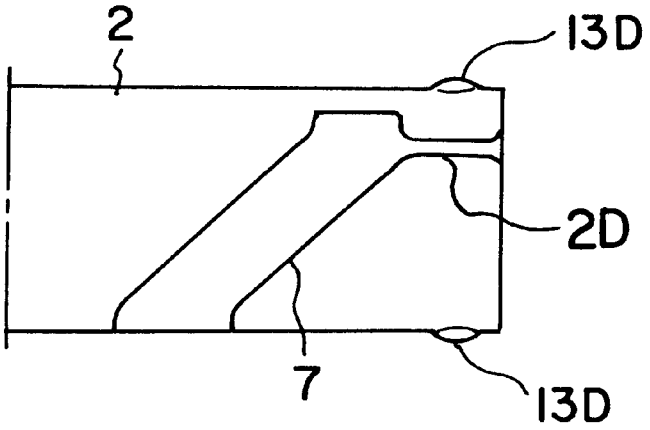
FIG. 6 is a partial front view of the front inner tubular member showing still another example of a friction generating means.

FIGS. 4 to 6 show another examples of a friction generating member.

In FIG. 4, washer 13B is disposed within annular groove 2*b* for biasing annular engaging member 14 rearwards. Washer 13B makes the force applied between a rear surface of annular engaging member 14 and a rear surface of annular groove 2*b* stronger and generates a friction force between them. A leaf spring etc. can be used instead of washer 13B.

In FIG. 5, slits 4*a* and projections 13C are provided on a portion of rear inner tubular member 4 for insertion into front inner tubular member 2. Projections 13C extend towards an inner surface of front inner tubular member 2 due to the elasticity caused by silts 4*a* so as to generate a friction force between the front inner tubular member 2 and the rear inner tubular member 4.

In FIG. 6, projections 13D are provided on a rear end portion of front inner tubular member 2. Projections 13D extend towards an inner surface of driver 10 due to the elasticity caused by slits so as to generate a friction force between front inner tubular member 2 and rear inner tubular member 4.

According to the present invention, the mechanism provided for transformation of rotation and axial displacement including the inclined path having the beginning end and terminal end and the projection engaged with the inclined path, it is simpler in construction and convenient and is easy for a ball-point pen to perform.

While the principles of the invention have been described above in connection with specific embodiments, and particular modifications thereof, it is to be clearly understood that this description is given only by way of example and not as a limitation on the scope of invention.

What is claimed is:

1. A writing instrument comprising;

a front tubular member (1);

a front inner tubular member (2) disposed within the front tubular member (1);

a refill (3) inserted into the front inner tubular member (2);

a driver (10) mounted in the front tubular member (1) and front inner tubular member (2), said driver (10) being rotatable but not axially displaceable relative to the front tubular member (1) and the front inner tubular member (2);

a rear tubular member (5) detachably connected to and non-rotatable relative to the driver (10);

a rear inner tubular member (4) inserted in the driver (10);

an inclined path (7) provided in one of the front inner tubular member (2) and the rear inner tubular member (4), said inclined path (7) extending obliquely relative to an axial line of the writing instrument from a beginning end (7A) to a terminal end (7B); and a projection (8) on the other of said front inner tubular member (2) and said rear inner tubular member (4), said projection (8) engaging said inclined path (7);

the rear inner tubular member (4) and the driver (10) interengaging with each other by engagement between at least one axial groove (11) and corresponding projection (12) to allow axial displacement but not rotation relative to the driver (10); and friction generator means (13A, 13D) constructed to forcibly contact a circumferential surface of either of said front inner tubular member (2) and said driver (10) whereby relative circumferential rotation between said front inner tubular member (2) and said driver (10) generates a substantial positive friction force.

2. A writing instrument comprising;

a front tubular member (1);

a front inner tubular member (2) disposed within the front tubular member (1);

a refill (3) inserted into the front inner tubular member (2);

a driver (10) mounted in the front tubular member (1) and front inner tubular member (2), said driver (10) being rotatable but not axially displaceable relative to the front tubular member (1) and the front inner tubular member (2);

a rear tubular member (5) detachably connected to and non-rotatable relative to the driver (10);

a rear inner tubular member (4) inserted in the driver (10);

an inclined path (7) provided in one of the front inner tubular member (2) and the rear inner tubular member (4), said inclined path (7) extending obliquely relative to an axial line of the writing instrument from a beginning end (7A) to a terminal end (7B); and a projection (8) provided on the other of said front inner tubular member (2) and the rear inner tubular member (4), said projection (8) engaging said inclined path (7);

the rear inner tubular member (4) and the driver (10) interengaging with each other by engagement between at least one axial groove (11) and corresponding projection (12) to allow axial displacement but not rotation relative to the driver (10); and friction generator means (13C) provided between said front inner tubular member (2) and said rear inner tubular member (4), whereby relative circumferential rotation between said front tubular member (2) and said rear inner tubular member (4) generates a substantial positive frictional force.

* * * * *